US007367548B2

(12) United States Patent
Rosenfeldt et al.

(10) Patent No.: US 7,367,548 B2
(45) Date of Patent: May 6, 2008

(54) METHOD AND APPARATUS FOR ELEVATED STORAGE OF ARTICLES

(75) Inventors: Lewis B. Rosenfeldt, Libertyville, IL (US); Robert McCarthy, Frankfort, IL (US); Dustin Vallely, Lake Forest, IL (US); Harry A. Pyster, Lincolnshire, IL (US)

(73) Assignee: Pinpoint Products, LLC, Orland Park, IL (US)

( * ) Notice: Subject to any disclaimer, the term of this patent is extended or adjusted under 35 U.S.C. 154(b) by 0 days.

(21) Appl. No.: 11/735,046

(22) Filed: Apr. 13, 2007

(65) Prior Publication Data

US 2007/0241576 A1 Oct. 18, 2007

Related U.S. Application Data

(60) Provisional application No. 60/792,483, filed on Apr. 17, 2006.

(51) Int. Cl.
*B66D 1/36* (2006.01)

(52) U.S. Cl. ..... 254/338; 254/355; 254/356; 254/366; 211/117; 211/120; 248/317; 248/320

(58) Field of Classification Search ..... 254/334, 254/338, 355, 356, 366, 375; 211/17, 117, 211/120; 248/317, 320, 322
See application file for complete search history.

(56) References Cited

U.S. PATENT DOCUMENTS 997,518 A * 7/1911 Taylor ..... 211/115
1,813,095 A 7/1931 Starkey et al.
1,830,003 A 11/1931 Shailor
2,145,666 A 1/1939 Roethel
2,643,749 A 6/1953 Greenlee
2,829,748 A 4/1958 Sacchini et al.
2,881,881 A 4/1959 Sacchini et al.
2,922,220 A 1/1960 Sacchini
2,927,551 A 3/1960 Bevis et al.
2,940,563 A 6/1960 Milenkovic et al.
3,006,448 A 10/1961 Fox
3,011,605 A 12/1961 Hungerford, Jr. et al.
3,104,745 A 9/1963 Wipke (Continued)

OTHER PUBLICATIONS

Harken Hoister Garage Storage Systems, Harken, Inc., Pewaukee, Wisconsin. <www.hoister.com> Date: Undated.

(Continued)

*Primary Examiner*—Emmanuel M Marcelo
(74) *Attorney, Agent, or Firm*—Jansson Shupe & Munger Ltd.

(57) ABSTRACT

Method and apparatus for elevated storage of articles including application of a spring clutch winch to provide the required lifting and holding forces. In preferred embodiments, the apparatus includes a spring clutch winch, one or more elongate elements payed out from and, alternatively, wound onto the winch, at least one rotational support supporting each elongate element and a hanger secured to an elongate element end. The article to be stored can be raised by winding each elongate element onto the spring clutch winch and can be lowered by unwinding the line from the spring clutch winch. Use of a spring clutch winch for this storage application provides a highly effective yet simple and cost effective manner of raising and lowering the article and securely holding the article in an elevated position.

12 Claims, 11 Drawing Sheets

U.S. PATENT DOCUMENTS

| | | | | | |
|---|---|---|---|---|---|
| 3,110,380 | A | | 11/1963 | Meyer et al. | |
| 3,135,369 | A | | 6/1964 | Nisenson et al. | |
| 3,302,762 | A | | 2/1967 | Conlon | |
| 3,307,663 | A | | 3/1967 | Luenberger | |
| 3,340,975 | A | | 9/1967 | Erickson | |
| 3,529,703 | A | | 9/1970 | Kroeker | |
| 3,712,431 | A | * | 1/1973 | Versoy | 192/12 B |
| 3,834,670 | A | * | 9/1974 | Pityo | 254/338 |
| 3,876,184 | A | * | 4/1975 | Eudy | 254/343 |
| 3,915,268 | A | | 10/1975 | MacDonald | |
| 3,920,106 | A | | 11/1975 | Nisenson | |
| 4,130,028 | A | | 12/1978 | Solberg | |
| 4,372,432 | A | | 2/1983 | Waine et al. | |
| 4,427,100 | A | | 1/1984 | Rude et al. | |
| 4,433,765 | A | | 2/1984 | Rude et al. | |
| 4,600,177 | A | * | 7/1986 | Fritz | 254/338 |
| 4,799,648 | A | | 1/1989 | Holm et al. | |
| 4,850,263 | A | | 7/1989 | Rumsey et al. | |
| 4,934,659 | A | * | 6/1990 | Yoke | 254/326 |
| 5,058,720 | A | | 10/1991 | Rude et al. | |
| 5,199,843 | A | | 4/1993 | Sferra | |
| 5,228,661 | A | * | 7/1993 | Bigham et al. | 254/276 |
| 5,460,274 | A | | 10/1995 | Kramer | |
| 5,474,189 | A | | 12/1995 | Peterson | |
| 5,851,098 | A | | 12/1998 | Buckenauer et al. | |
| 5,893,696 | A | | 4/1999 | Belinsky | |
| 5,909,791 | A | | 6/1999 | DiStefano | |
| 6,056,274 | A | * | 5/2000 | Naas et al. | 254/335 |
| 6,095,344 | A | | 8/2000 | White | |
| 6,095,500 | A | | 8/2000 | McVaugh | |
| 6,116,797 | A | | 9/2000 | Brewington et al. | |
| 6,119,841 | A | | 9/2000 | Orlamunder | |
| 6,161,702 | A | | 12/2000 | Campbell | |
| 6,237,781 | B1 | * | 5/2001 | Dahl | 211/17 |
| 6,386,515 | B1 | * | 5/2002 | Sachtleben | 254/338 |
| 6,409,153 | B1 | | 6/2002 | Norris | |
| 6,484,861 | B1 | | 11/2002 | Wussow | |
| 6,659,248 | B2 | | 12/2003 | Terada | |
| 6,676,233 | B1 | | 1/2004 | Evans et al. | |

OTHER PUBLICATIONS

Racor Home Storage Products, Racor Incorporated, Sandpoint, Idaho. <www.racorinc.com> Date: Copyright 2004.

Hyloft Storage Solutions, Hyloft, Inc., Las Vegas, Nevada. <www.hyloft.com> Date: 2004.

Bianchina, P., "Overhead Storage Units Go Above and Beyond." The Oregonian. Date: Dec. 11, 2005.

Excerpt from Brookstone catalog. Date: Copyright 2005.

Excerpt from Apex Storage Lifts, Inc. webpage. Date: Copyright 2004.

* cited by examiner

METHOD AND APPARATUS FOR ELEVATED STORAGE OF ARTICLES

RELATED APPLICATION

This application claims the benefit of U.S. Provisional Ser. No. 60/792,483, filed Apr. 17, 2006, the entire content of which is incorporated herein by reference.

FIELD

The invention relates to article storage and, more specifically, to elevated article storage.

BACKGROUND

Families, business and others require ways to store a wide range of personal property articles at their residences, workplaces and other storage locations when the articles are not in use. Virtually an unlimited range of personal property articles require such storage. Representative types of articles which require storage can include, for example, ladders, lawn mowers, spreaders, tools, automobile detachable seats, bicycles and goods stored in boxes, crates or totes.

Personal property articles can be stored in many different locations within a residence, workplace or other storage location. Representative locations can include garages, car ports, basements, warehouses, sheds as well as other locations. These locations typically include a floor and a ceiling or roof supported by joists, trusses or like supports. The ceiling or roof supports are typically supported by vertical supports which may further support one or more walls.

Typically, the available space for storage of articles in a residence or workplace is limited and there is a need to optimize such space. One way to optimize storage space is to take advantage of the available volumetric space in the storage location by storing articles on the floor and at positions above the floor.

Many attempts to store articles at elevated positions are known. Examples include U.S. Pat. No. 6,237,781 (Dahl) and U.S. Pat. No. 6,161,702 (Campbell). Traditional block-and-tackle devices have also been utilized. While such devices may be satisfactory for their intended purposes, there are disadvantages associated with such devices.

For example, these types of storage systems may require complex electrical and mechanical components which are costly and subject to failure. Such electrical and mechanical components may require complex mounting to the ceiling or ceiling joists and may be difficult and costly to install.

Block and tackle lift devices secured to a ceiling or ceiling support can be difficult for some persons to operate because such persons may have difficulty pulling the line. Block and tackle lift devices can fail if the line or lines are not tied off or secured properly. The result of any such failure is that the articles will crash down potentially damaging the stored articles or damaging automobiles or other valuable things onto which the articles may fall.

It would represent a significant improvement in the art to provide apparatus and methods for elevated, secure storage of articles thereby optimizing storage space, which can be used to reliably store a wide range of articles and things and which is very simple and economical in its manufacture and use.

BRIEF DESCRIPTION OF THE DRAWINGS

The invention may be understood by reference to the following description taken in conjunction with the accompanying drawings, in which like reference numerals identify like elements throughout the different views. The drawings are not necessarily to scale, emphasis instead being placed upon illustrating the principles of the invention.

DETAILED DESCRIPTION OF PREFERRED EMBODIMENTS

Figure 1:
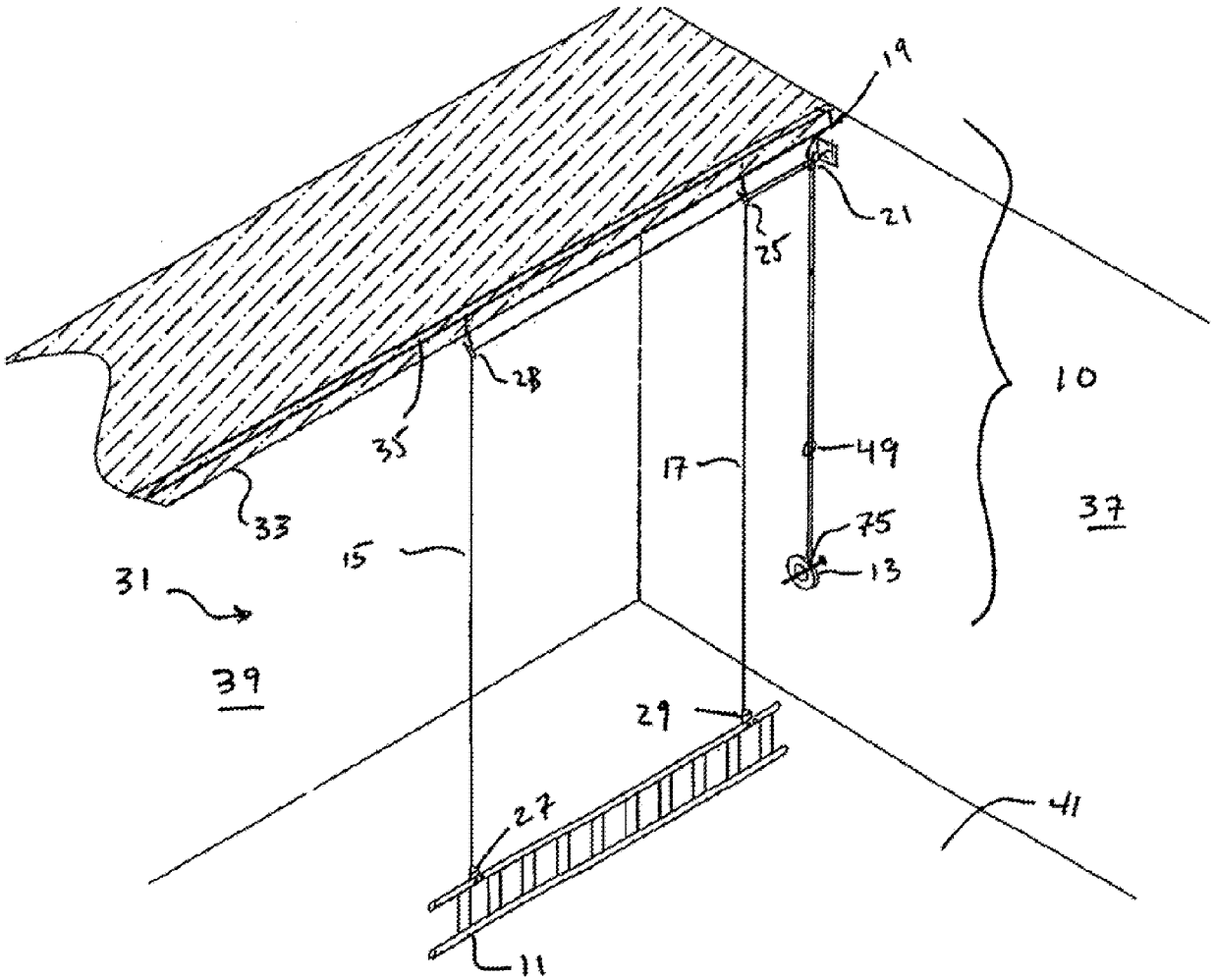
FIG. 1 is a perspective view of one embodiment of an apparatus for elevated storage of articles. The apparatus is shown supporting an exemplary article in the form of a ladder. The ladder is shown in a lowered position.
Figure 2:
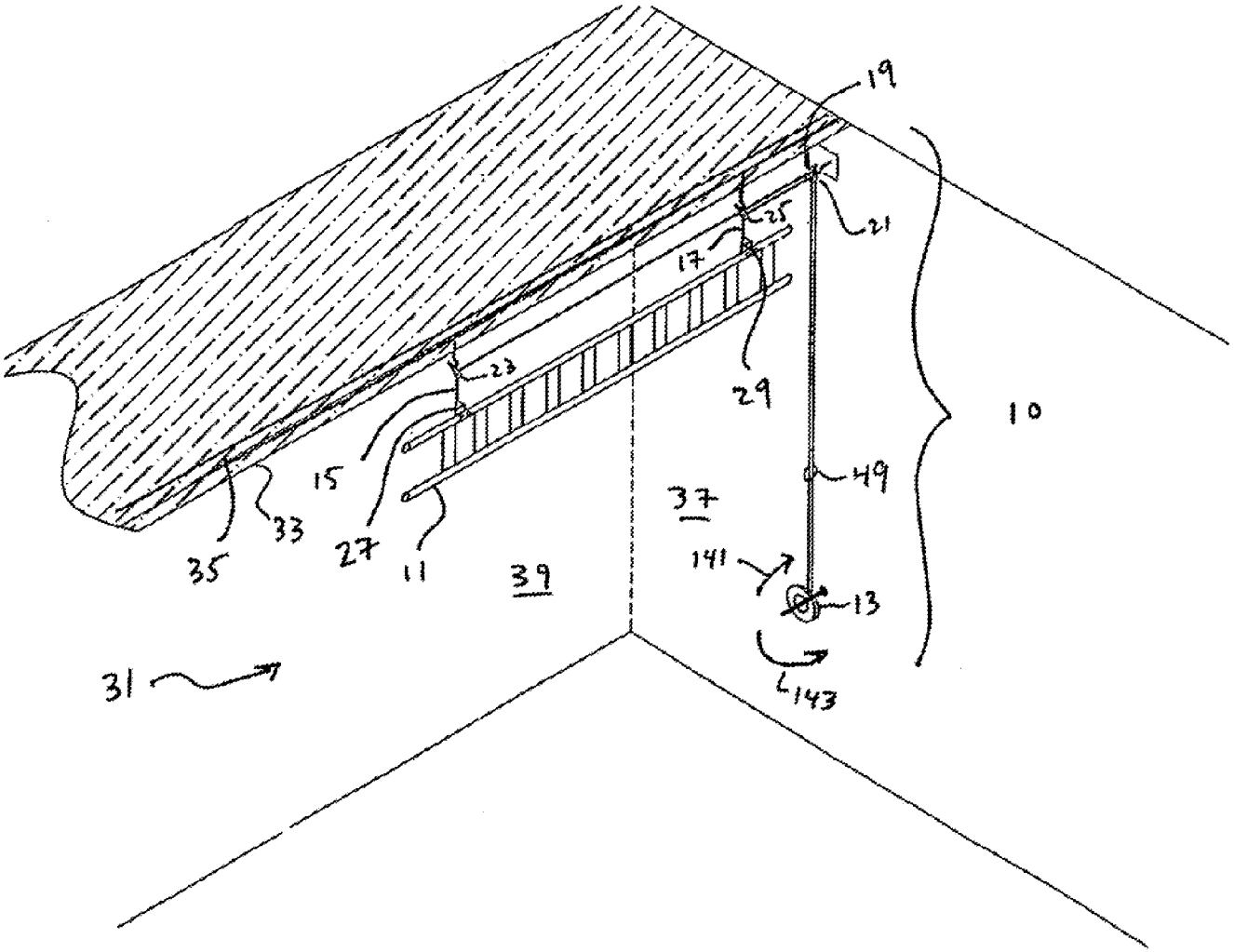
FIG. 2 is a perspective view of the embodiment of FIG. 1. The exemplary ladder is shown in an elevated position supported and stored above the floor.
Figure 3:
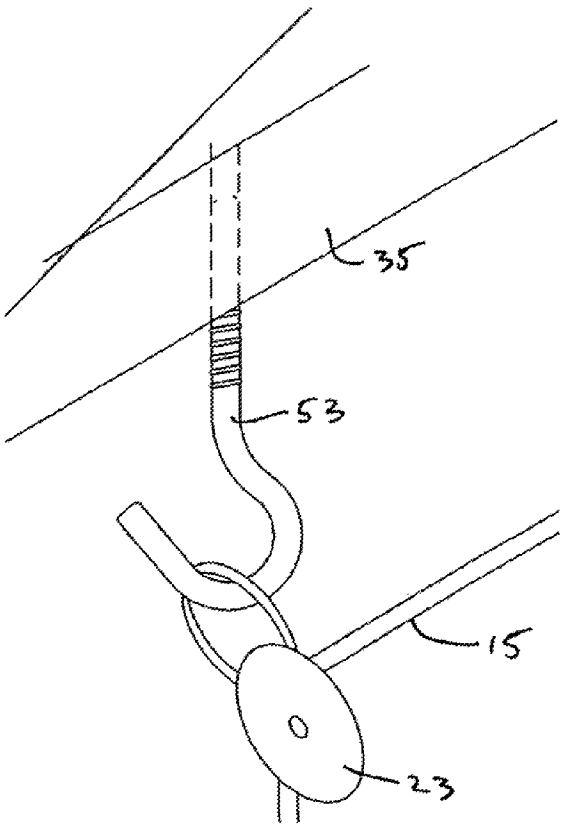
FIG. 3 is an enlarged perspective view of a portion of the embodiment of FIGS. 1 and 2. Certain portions are shown in phantom line or are cut away to facilitate the reader's understanding.
Figure 4:
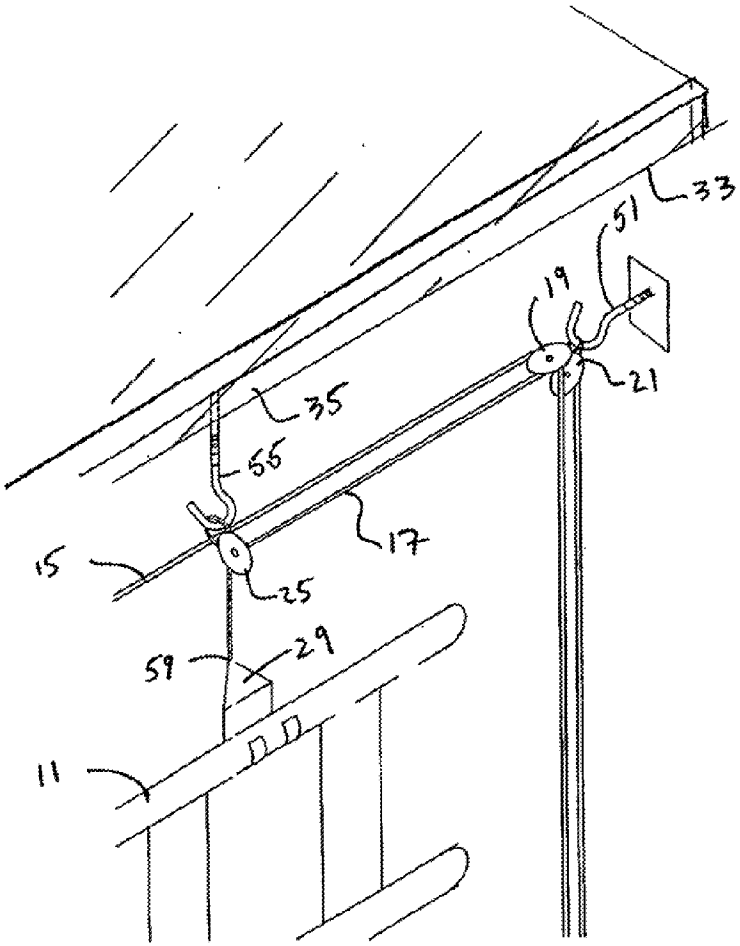
FIG. 4 is an enlarged perspective view of a further portion of the embodiment of FIGS. 1 and 2. Certain portions are shown in phantom line or are cut away to facilitate the reader's understanding.

Referring first to FIGS. 1 and 2, there is shown a preferred embodiment of an apparatus 10 for elevated storage of one or more articles 11. Apparatus 10 includes a spring clutch winch 13, elongate elements 15, 17 adapted to be wound onto winch 13 and, alternatively, payed out from winch 13, rotational supports preferably in the form of pulleys 19, 21, 23, 25 and hangers 27, 29.

As will be explained in detail below, a particularly important aspect of the invention is the recognition that a spring clutch winch 13 is ideally suited for use with apparatus 10. Use of a spring clutch winch 13 in conjunction with apparatus 10 enables apparatus 10 to perform all of its intended functions while providing important advantages relevant to the needs and expectations of apparatus 10 users.

Referring again to FIGS. 1 and 2, apparatus 10 is shown for use in an exemplary room 31 consisting of a ceiling 33, wood ceiling joists (one of which is indicated by reference number 35) supporting ceiling 33, generally vertical walls 37, 39 and a floor 41. Room 31 is intended to represent any space suitable for storing articles including, without limitation, a garage, car port, basement, warehouse and shed. It is anticipated that apparatus 10 may be used in many different room 31 configurations.

Figure 21:
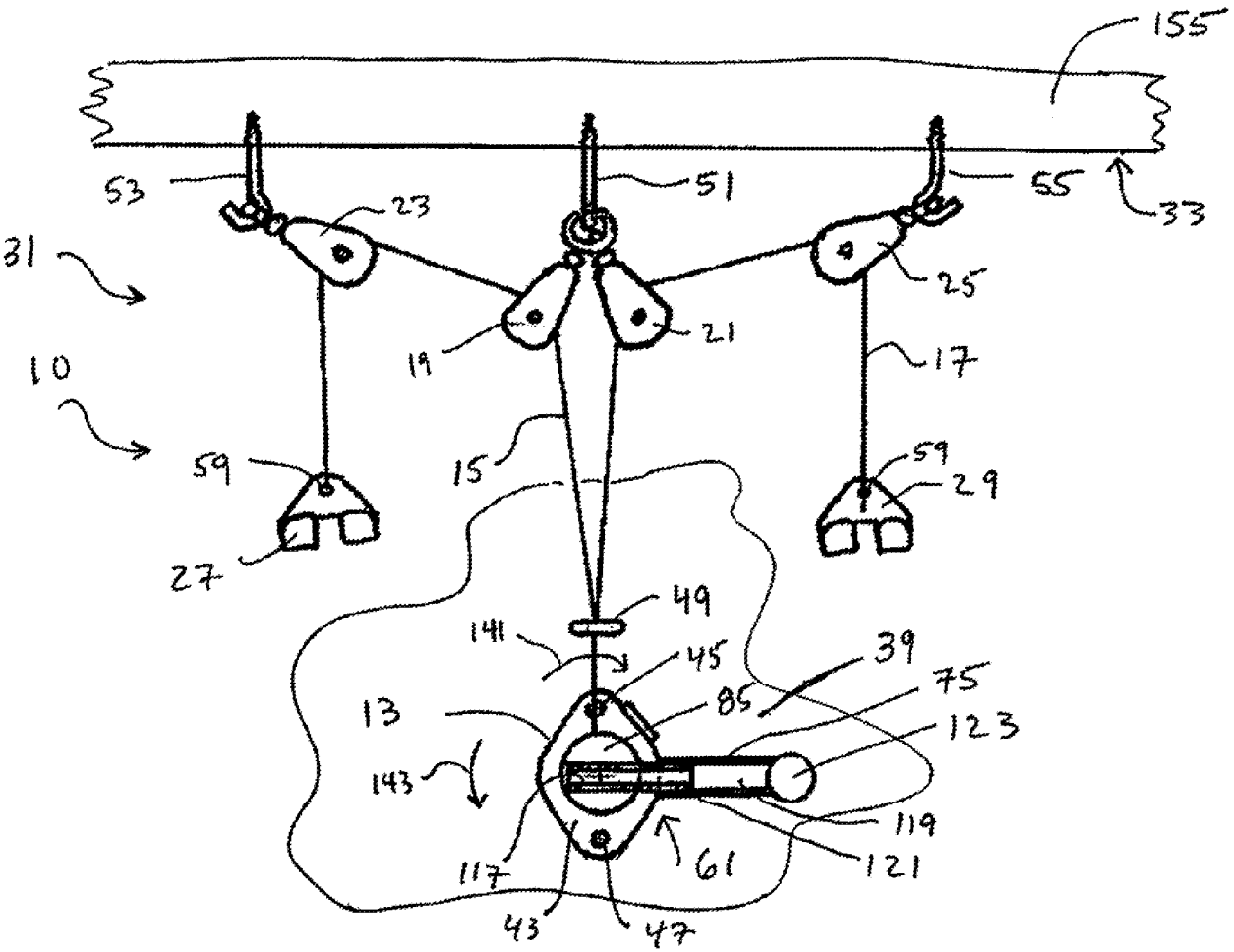
FIG. 21 is a front elevation view of a further configuration of an apparatus for elevated storage of articles.

FIGS. 1-4, show apparatus 10 being used in connection with elevated storage of an article 11 in the form of a ladder. (An alternative configuration of apparatus 10 is shown in FIG. 21.) Virtually any type of article 11 capable of being lifted and stored may be stored by means of apparatus 10. By way of example only, such articles 11 may include ladders, lawn mowers, spreaders, tools, automobile detachable seats, bicycles and goods stored in boxes, crates or totes. For use in consumer residential applications, it is preferred that apparatus 10 be capable of lifting and storing one or more articles 11 weighing up to about 100 pounds. However, apparatus 10 may be made more robust for supporting greater loads.

Figure 9:
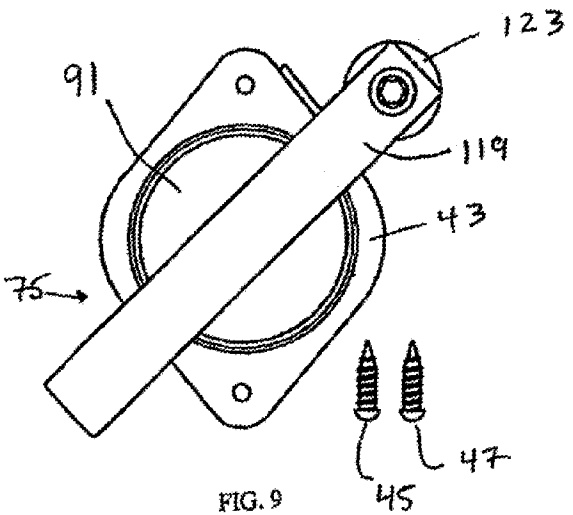
FIG. 9 is a front elevation view of the exemplary winch and fasteners of FIG. 5.
Figure 11:
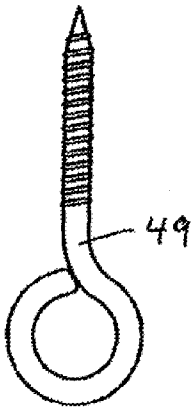
FIG. 11 is a side elevation view of an exemplary threaded eyelet.
Figure 10:
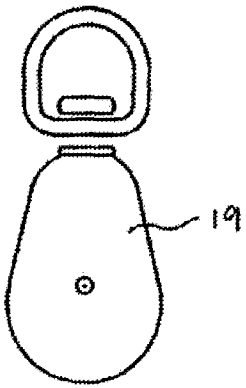
FIG. 10 is a side elevation view of an exemplary pulley.
Figure 14:
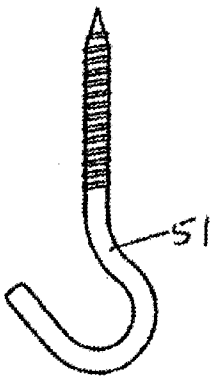
FIG. 14 is a side elevation view of an exemplary threaded hook.
Figure 15:
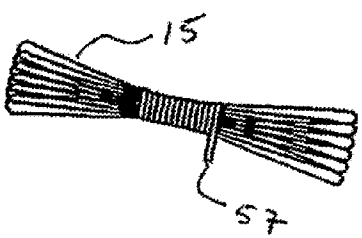
FIG. 15 is an exemplary elongate element shown as a coil.

Referring further to FIGS. 1-5, winch 13 is preferably secured to wall 37 by securing winch wall plate 43 to wall 37 by means of fasteners 45, 47 (FIG. 9). Lag bolts, screws and other types of suitable fasteners may be utilized. Wall plate 43 should be mounted securely to wall 37 and it is preferred that fasteners (i.e., fasteners 45, 47) be secured to a wood wall stud (not shown) or directly into wall 37 if, for example, wall 37 is made of a material such as brick or concrete block.

Winch 13 is preferably mounted to wall 37 about waist-high to facilitate ease of use. However, winch 13 may be mounted at any suitable position on wall 37. Winch 13 maybe mounted to surfaces other than wall 37, such as along ceiling 33.

As illustrated in FIGS. 1-4, an eye hook 49 may optionally be mounted directly above winch 13 to serve as a guide for elongate elements 15, 17 threaded therethrough.

The preferred pulley-type 19-25 rotational supports provide anchor points for elongate elements 15, 17. Typical pulleys useful for pulleys 19-25 will include a grooved wheel which rotates about an axle supported on a mounting bracket. A hook or eye extending from the mounting bracket may be used to connect the pulley 19-25 to an anchor mounted to a wall or ceiling thereby creating the anchor point. Rotational supports other than pulleys 19-25 may be used. For example, a bearing roller (not shown) could be used in place of a pulley 19-25.

Pulleys 19, 21 may be mounted to an anchor such as J-shaped hook 51 screwed into wall 37 stud (not shown) behind wall 37 or to another secure mounting point. A single pulley may be used in place of pulleys 19, 21 if desired. Pulleys 23, 25 may be mounted on respective anchors such as J-shaped hooks 53, 55 screwed into ceiling joist 35. In the embodiment of FIGS. 1-4, ceiling joist 35 is perpendicular to wall 37 on which spring clutch winch 13 is mounted.

In the embodiment of FIGS. 1-4, pulleys 19-25 are shown in a preferred position in which each pulley 19-25 is at an anchor point position above winch 13. Additional pulleys (not shown) could be mounted along wall 37 to a side of winch 13 if it is desired to change the direction of elongate element 15, 17 travel. While simple fixed pulleys 19-25 are shown, it will be understood that compound pulleys may be used, particularly in place of pulleys 23, 25.

Elongate elements 15, 17 are flexible members provided to lift article 11 and to hold article 11 when stored in the elevated position of FIG. 2. Each elongate element 15, 17 enables force from winch 13 to be used to lift articles 11. Preferred types of elongate elements 15, 17 are rope, line and cable. Rope and line are preferably made of low-stretch materials such as polyester or kevlar. However, and depending on the intended load to be lifted and stored, materials such as polypropylene, polyethylene, polyester and nylon may be used. Diamond braid eight carrier polyester rope (650 lbs. tensile strength) is an example of a material suitable for use as elongate elements 15, 17. Any type of material may be used provided that the material has adequate strength for the intended load.

Elongate elements 15, 17 have a length which is sufficient to extend from winch 13, through the respective pulleys 19-25 and to the article 11 to be lifted and stored. Elongate elements 15, 17 may each have the same length or may have a different length depending on the application. Elongate elements 15, 17 each further have a first and second end 57, 59.

While two elongate elements 15, 17 are shown, persons of skill in the art will appreciate that any suitable number of elongate elements may be utilized. For example, a single elongate element (not shown) could be utilized or three elongate elements (not shown) could be utilized.

Hangers 27, 29 are provided to connect article 11 to elongate elements 15, 17. A preferred hanger 27, 29 embodiment is shown in FIGS. 1-2, 4 and 12-13. Hangers 27, 29 are devices by which or to which an article 11 is hung or hangs. The preferred hanger 27, 29 has a first end 65 defining an opening 67 for receiving an elongate element second end 59 and a second end 69 defining one hook or plural hooks 71, 73 for connection to article 11. An elongate element second end 59 is extended through an opening 67 and is knotted or is tied around hanger 27, 29 first end 65 to connect hanger 27 or 29 to the respective elongate element 15, 17. Hangers 27, 29 are preferably made of rigid material capable of safely lifting and holding article 11, such as metal or plastic. For example, hangers 27, 29 may be stamped from carbon steel sheet stock.

Figure 13:
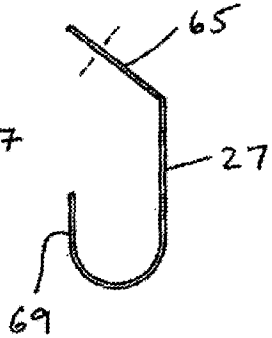
FIG. 13 is a side elevation view of the exemplary hanger of FIG. 12.
Figure 12:
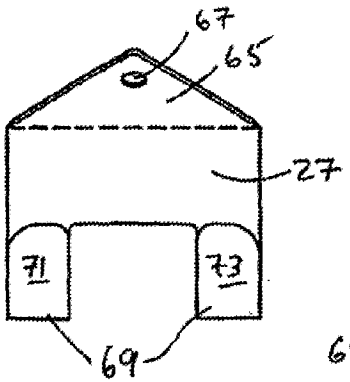
FIG. 12 is a front elevation view of an exemplary hanger.

While the preferred hangers 27, 29 have a generally J-shaped side profile as shown in FIG. 13, any hanger shape or configuration may be utilized provided that an article may be hung or suspended from the hanger. Clasps, clips, belts, bands, velcro and other materials and configurations may be used for hangers 27, 29.

Spring clutch winch 13 is an important aspect of apparatus 10. Spring clutch winch 13 is provided to generate the force required to lift and hold article 11 through elongate elements 15, 17 and pulleys 19-25. As shown in FIGS. 16-19, other spring clutch winch embodiments 13', 13" are contemplated for use with apparatus 10.

A spring clutch winch 13 is ideal for use with apparatus 10 for at least the following four important reasons. First, a spring clutch winch 13 can be easily used and operated by one person making it possible for one person to easily lift, lower and store an article without assistance from another person.

Second, a spring clutch winch 13 provides a positive braking mechanism which arrests winch movement when force on the winch drive mechanism 61 is abated. This important feature permits an article 11 to be stored in the elevated position simply by stopping the winch drive mechanism 61, The necessity to secure or cleat a line typical of block-and-tackle devices is completely avoided. Avoidance of any necessity to cleat a line minimizes the possibility that an elevated article 11 could fall.

Third, a spring clutch winch 13 is a simple, durable, product which requires few parts and can be manufactured in a cost-effective manner. For example, essentially all of the parts comprising the winch can be stamped at a low cost from carbon steel sheet stock material. Such parts can be joined together by simple tack welding. Because spring clutch winch 13 is elegantly simple, the manufacturer should be able to economically manufacture the winch 13.

Figures 18, 19:
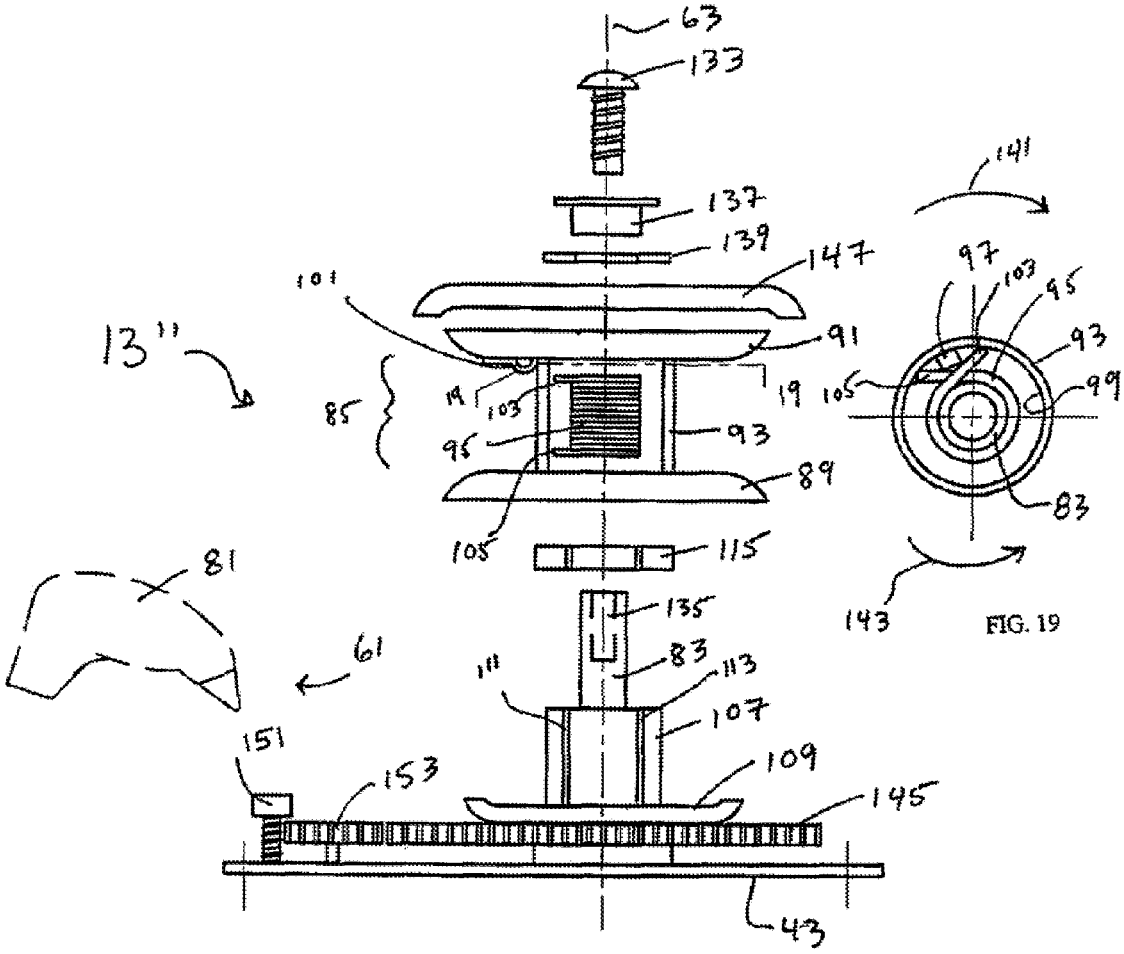
FIG. 18 is an exploded view of a further spring clutch winch embodiment.
FIG. 19 is a section view taken along section 19-19 of FIG. 18.

Fourth, a spring clutch winch 13 may be adapted for use with a variety of drive mechanisms 61 providing the manufacturer considerable latitude in making and selling different versions of apparatus 10 to better meet customer demand. Such drive mechanisms 61 can include a simple lever 75 (FIGS. 1-2, 5-6, 9, 21), a wheel 77 (FIG. 20), a dedicated motor 79 and power source 80 (FIG. 16) or a detachable motor 81 (FIG. 18). Each of these advantages will be apparent from the winch description which follows.

Referring then FIGS. 5-8, a preferred manually-operated spring clutch winch 13 will be now be described. Spring clutch winch 13 includes a plate 43 configured to be attached by fasteners (e.g. fasteners 45, 47) to a vertically-oriented surface such as wall 37. A generally cylindrical axle 83 extends outwardly from plate 43 along axis 63.

A rotatable spool 85, (also referred to in industry as a drum), is coaxially mounted over axle 83. Spool 85 may be rotated bi-directionally in the clockwise and counterclockwise directions of arrows 141 and 143. Bushing 87 is seated on axle 83 between spool 85 and plate 43. Bushing 87 may be made of a low-friction material such as nylon. Spool 85 includes inner and outer spool plates 89, 91 and spool center 93 onto which elongate elements 15, 17 are wound.

In the embodiment, spool inner plate 89 includes a diametrical opening (hidden behind spring 95 in FIG. 7) with an inner diameter which is slightly oversized relative to axle 83 outer diameter and through which axle 83 is inserted. In the embodiment, spool center 93 is a cylindrical hub which is oversized relative to axle 83 and has an inner diameter greater than an axle 83 outer diameter. Inner diameter of spool center 93 is sufficient to accommodate spring 95 therein when spool 85 is mounted on axle 83. A nub 97 spans between inner and outer spool plates 89, 91 along inner surface 99 of spool center 93 for a purpose which will be described below.

A spool rope cup 101 is provided on outer spool plate 91. Cup 101 is provided to secure each elongate element first end 57 to spool 85 and winch 13. Each first end 57 is threaded through cup 101 and is knotted to secure each elongate element 15, 17 to spool 85 and winch 13.

A helical torsion spring 95 provides the spring component of the spring clutch mechanism. Spring 95 includes a pair of spring arms 103, 105 and is preferably made of 0.120 wound carbon steel music wire made to ASTM-A228.

Figures 6, 7:
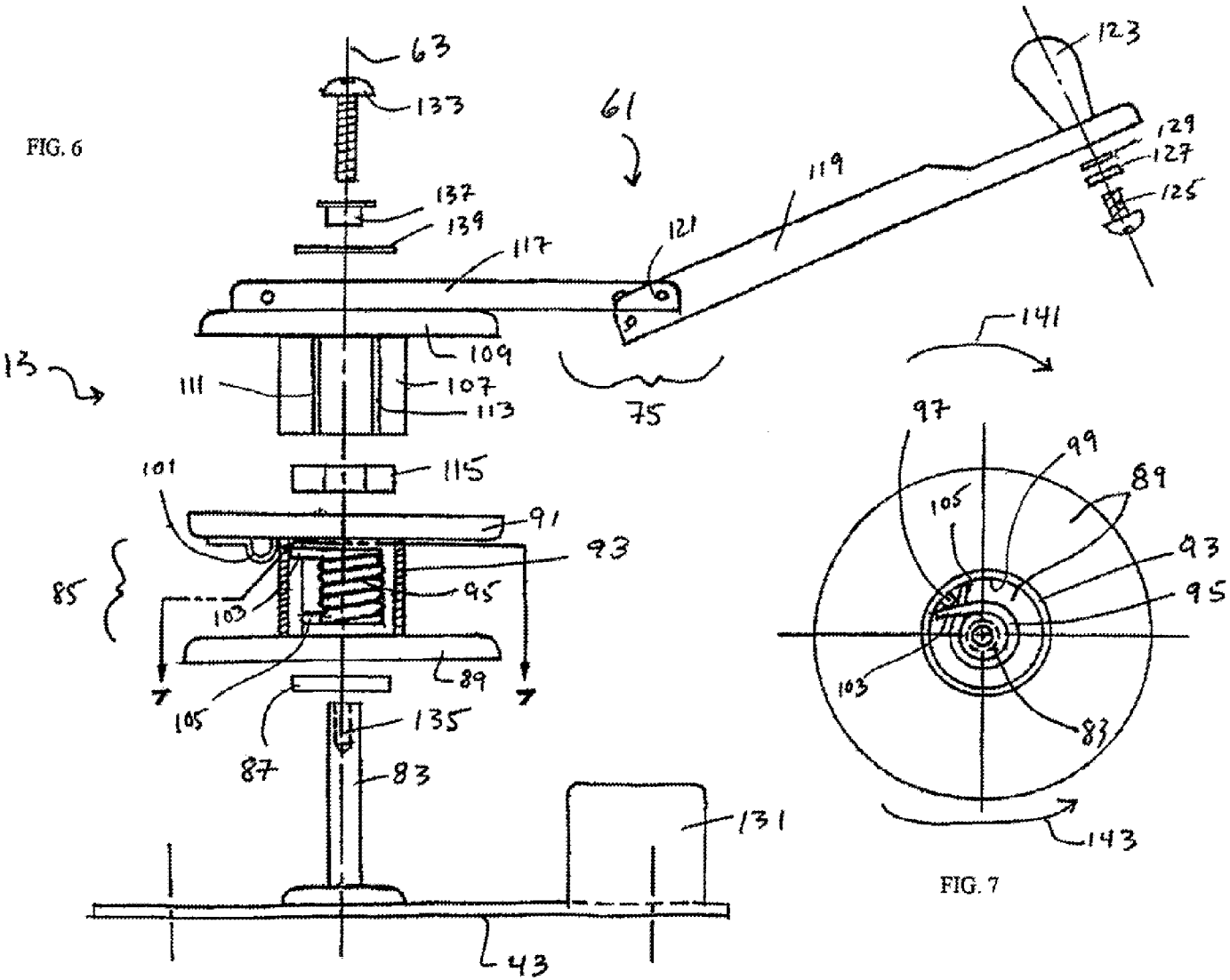
FIG. 6 is an exploded view of the exemplary winch of FIG. 5.
FIG. 7 is a section view taken along section 7-7 of FIG. 6.
Figure 8:
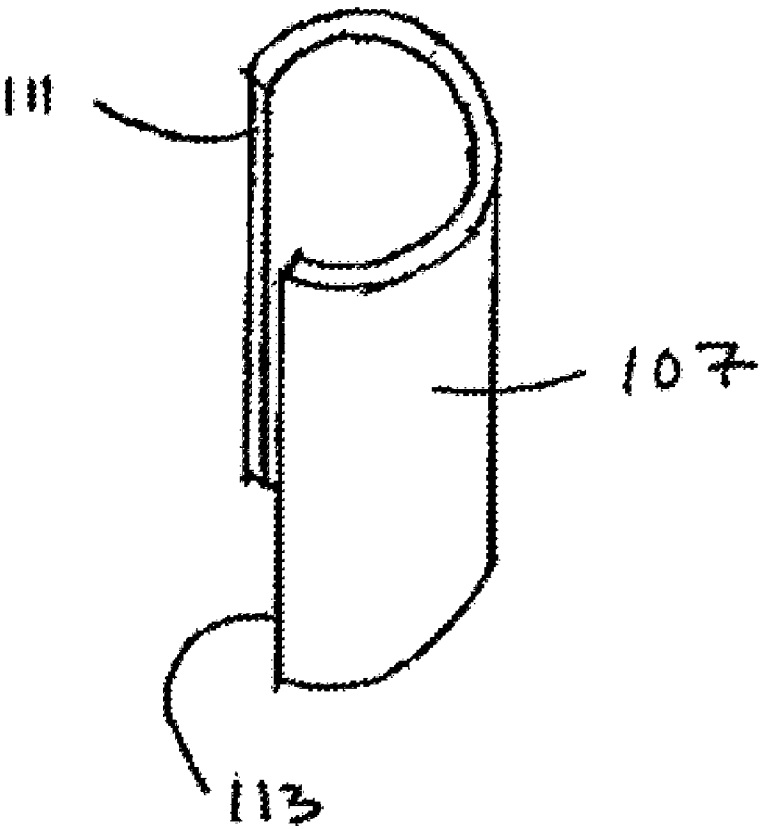
FIG. 8 is a portion of an exemplary winch spool driver portion. The spool driver is shown apart from the winch to facilitate the reader's understanding.
Figures 16, 17:
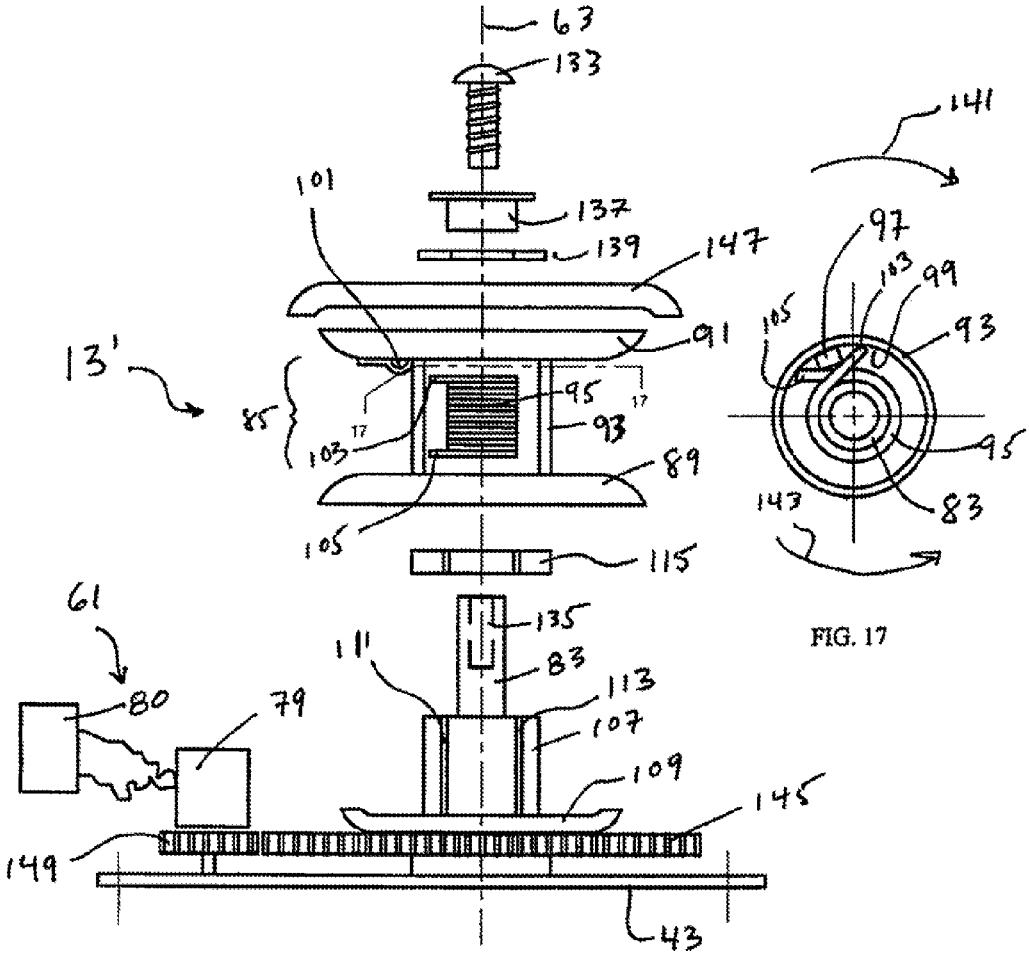
FIG. 16 is an exploded view of an alternative spring clutch winch embodiment.
FIG. 17 is a section view taken along section 17-17 of FIG. 16.

Spring 95 is fitted coaxially onto axle 83 and in tight frictional contact with axle 83 so that spring 95 is located within spool center 93 between inner and outer spool plates 89, 91 when spool 85 is mounted over axle 83. (Spool center 93 in FIGS. 6, 16 and 18 is partially cut away to facilitate understanding of the position of spring 95.) When relaxed, spring 95 has an inner diameter which is less than the outer diameter of axle 83. Spring 95 is fitted tightly onto axle 83 by twisting spring arms 103, 105 in opposite directions thereby partially unwinding spring, expanding the inner diameter of spring 95 and enabling spring 101 to be fitted onto axle 83. Spring 95 clamps tightly onto axle 83.

Nub 97 is positioned between spring arms 103, 105 as shown in FIGS. 7, 17 and 19. When spring 95 is clamped onto axle 83, spring arms 103, 105 act against nub 97 to limit and stop rotation of spool 85 in both clockwise and counterclockwise directions 141, 143.

Importantly, spring 95 provides sufficient frictional force against axle 83 to prevent rotation of spool 85 when an article 11 is in the elevated position for storage. Such frictional force permits winch 13 to hold article 11 in the elevated position for storage for extended time periods without unwanted reverse winch rotation which would result in the article 11 being lowered to the floor 41.

Referring further to FIGS. 5-8, rotatable spool driver 107 extends inwardly from driving plate 109. A drive mechanism 61 comprising manually-operated lever 75 is attached to driving plate 109. Spool driver 107, driving plate 109 and lever may be rotated bi-directionally in the clockwise and, alternatively, counterclockwise directions of arrows 141, 143. Spool driver 107 has an outer diameter sized to fit within the inner diameter of spool center 93.

Spool driver 107 is provided with spring arm contact surfaces 111, 113. Contact surface 111 contacts spring arm 103 when spool driver 107 is rotated in a clockwise direction 141 and contact surface 113 contacts spring arm 105 when spool driver is rotated in a counterclockwise 143 direction. Drive mechanism 61 comprising lever 75 increases the contact force between the respective contact surfaces 111, 113 and respective spring arm 103, 105 as described below.

Spool driver bushing 115 is coaxially fitted around axle 83 within spool driver 107. Bushing 115 may be made of a low-friction material such as nylon.

Figure 5:
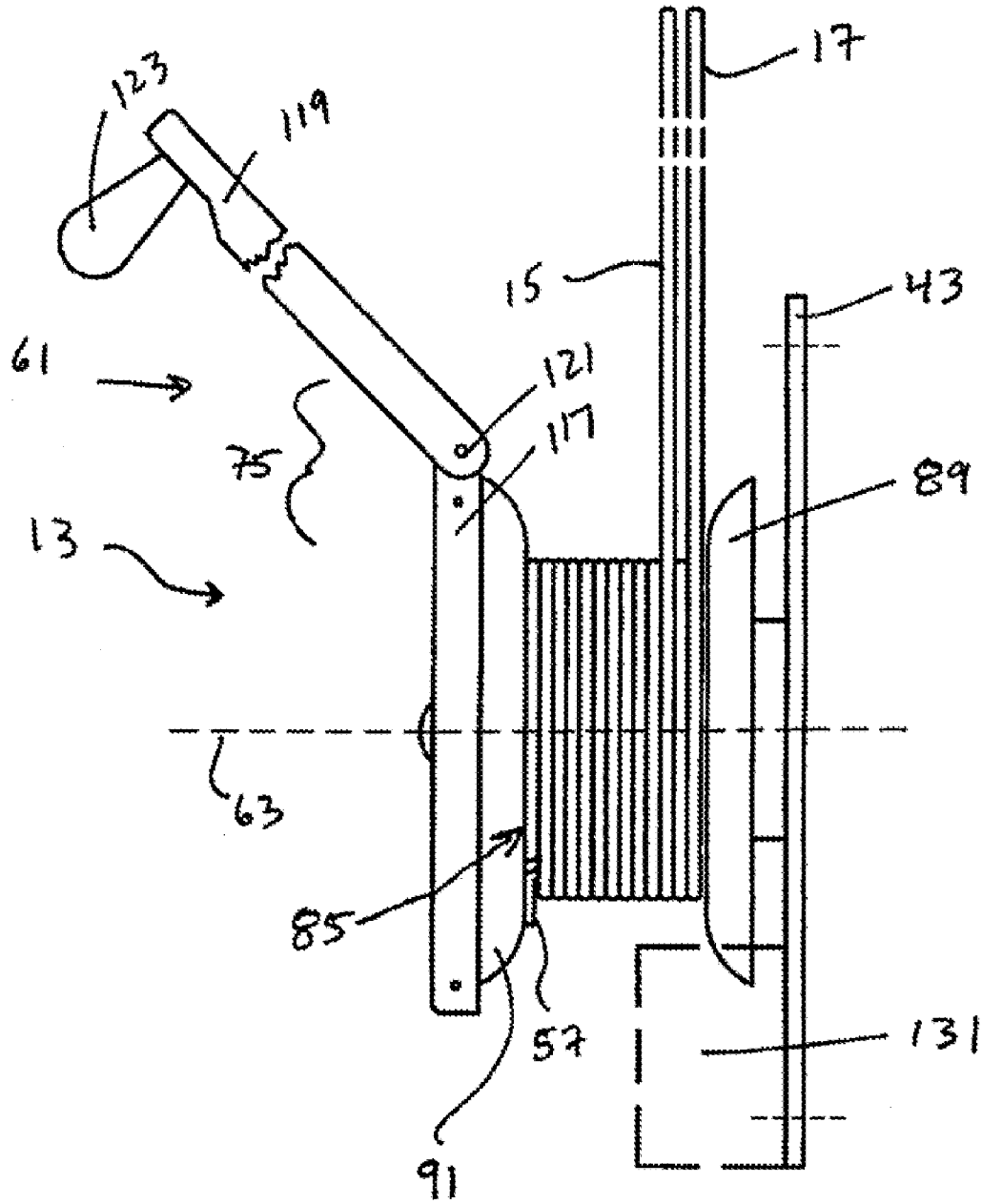
FIG. 5 is an enlarged side elevation view of an exemplary spring clutch winch of the embodiment of FIGS. 1 and 2.
Figure 20:
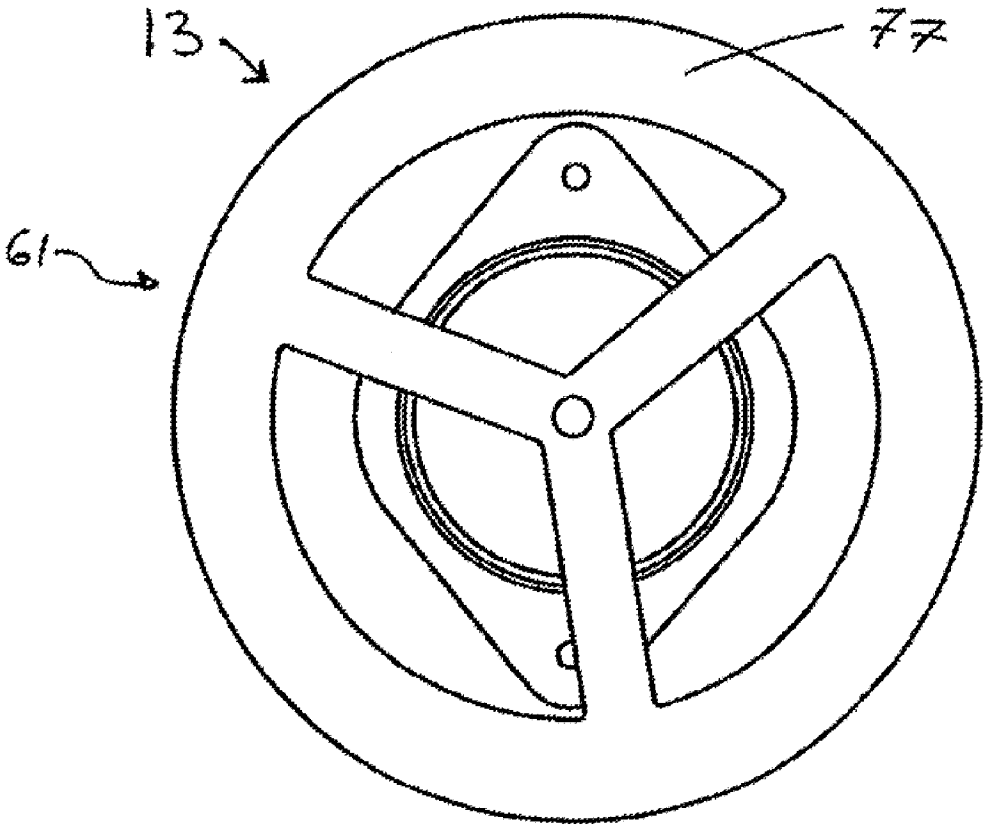
FIG. 20 is front elevation view of an exemplary winch wheel.

Referring to FIGS. 5-6 and 9, lever 75 may be a folding lever to make the winch 13 more compact. Such a lever 75 includes a first segment 117 secured to spool driver and driving plate 107, 109, a second segment 119 and a hinge 121 joining the segments 117, 119. A knob 123 maybe connected to segment 119 to facilitate rotation of lever 75. Knob 123 is held on segment 119 by machine screw 125 fitted over washers 127, 129. A stop 131 may be provided to contact knob 123 when lever segment 123 is in the folded position to prevent lever 75 movement. A wheel 77 may be used in place of lever as shown in FIG. 20.

Outward movement of driving plate 109 is prevented by machine screw 133 screwed into axle threaded opening 135 over bushing 137 and washer 139.

When rotational force is applied to spring 95 through lever 75, driving plate 109 and spool driver 107 in a clockwise 141 or counterclockwise 141 direction, spring 95 unwinds slightly, expanding radially outward from axle 83 thereby permitting spring 95 to be rotated about axle 83. This, in turn, causes a spring arm 111 or 113 to contact nub 97 to urge spool 85 to rotate in the same direction thereby either winding elongate elements 15, 17 onto spool 85 or paying out elongate elements 15, 17 from spool 85. Further operational details are provided below.

Winch 13 may be modified to support heavier loads in the elevated position shown in FIG. 2. For example, axle 83 may be made more robust and two helical torsion springs (not shown) may be used in place of torsion spring 95. To provide the additional force necessary to loosen such springs to rotate spool 85 to wind or pay out elongate elements 15, 17, a large-diameter wheel 77 (FIG. 20) may be secured to driving plate 109 in place of lever 75.

FIGS. 16-19 illustrate two alternative spring clutch winch 13' and 13" embodiments. For convenience and brevity, like reference numbers are used for parts which are common to spring clutch winches 13, 13' and 13" and the description of such parts is incorporated herein by reference.

Winch embodiments 13' and 13" differ from winch 13 primarily with respect to the structure of driving plate 109 and the drive mechanism 61 used to power bi-directional rotation of spool 85. According to winch embodiments 13' and 13", driving plate 109 is proximate wall plate 43 rather than spool outer plate 91. Spool driver 107 is fixed to driving plate 109 as in winch 13 but extends in a direction away from wall plate 43. Drive gear 145 is fixed to driving plate 109 between wall plate 43 and driving plate 109. Driving plate 109, spool driver 107 and drive gear 145 are coaxially mounted along axis 63 of axle 83 for bi-directional rotation.

Spring 95 is preferably identical to the torsion spring utilized in connection with winch 13 including spring arms 111, 113. As with the previous embodiment 13, spring 95 is fitted coaxially over axle 83 such that spring 95 is clamped radially onto axle 83. A respective spool driver contact surface 111, 113 contacts a respective spring arm 103, 105 to urge spring 95 to unwind slightly so as to permit spring 95 to rotate about axle 83 as described in connection with winch embodiment 13.

Spool 85 is again coaxially mounted for bi-directional rotation on axle 83 with spring 95 located within spool center 93. Spool inner plate 89 includes a diametrical opening (not shown) with an inner diameter which is sufficient to receive spool driver 107. As illustrated in FIGS. 17 and 19, nub 97 is located within spool center 93 for the purpose described in connection with winch embodiment 13. Spool plate 147 is held in place over spool outer plate 91 by machine screw 133 seated in axle threaded opening 135, bushing 137 and washer 139.

Winch embodiments 13', 13" differ with respect to their respective drive mechanisms 61. Winch embodiment 13' is powered by a dedicated electric motor and power source shown schematically by reference numbers 79, 80 in FIG. 16. Winch embodiment 13" is powered by a detachable electric motor, such as provided by an electric hand-held drill, which is shown schematically by reference number 81 in FIG. 16. There is no particular limitation with respect to the type of motor selected for use with either winch 13', 13" provided that such motor can generate sufficient torque to overcome the frictional force applied to axle 83 by spring 95 and to lift the desired article 11.

Referring then to FIG. 16 and winch embodiment 13', motor 79 is in power-transmission relationship with spool 85 through input gear 149 which meshes with drive gear 145 fixed to driving plate 109. Rotation of driving plate 109 in either a clockwise 141 or counterclockwise direction 143 causes spool driver 107 to urge spring 95 to expand radially and to rotate about axle 83. During rotation, one spring arm 103, 105 is urged into contact with nub 97 thereby rotating spool 85 to either wind elongate elements 15, 17 onto spool 85 or pay out elongate elements from spool 85 depending on the direction of spool rotational travel.

Referring to FIG. 18 and winch embodiment 13", motor 81 is in power-transmission relationship with spool 85 through worm gear 151, intermediate gear 153 and drive gear 145. As with winch embodiment 13', rotation of driving plate 109 in either a clockwise 141 or counterclockwise direction 143 causes spool driver 107 to urge spring 95 and spool 85 to rotate. If a hand-held drill is utilized as motor 81, a special bit (not shown) may be chucked in the drill and such bit may be keyed to mesh with and rotate worm gear 153. Worm gear 151 may be further adapted to mesh with a wrench or like tool so that worm gear 151 may be rotated in the absence of a motor 81.

Optionally, a pawl (not shown) may be pivotally mounted on wall plate 43 and configured to mesh with one of gears 145, 149 or 153 to prevent rearward rotation of such gears and to arrest spool 85 rotational movement when articles are stored in the elevated position of FIG. 2. Such a pawl may be useful to prevent unwanted downward movement of an elevated article 11, particularly if the article 11 is unduly heavy. Such pawl could be moved out of contact with any of gears 145, 149, 153 during powered rotation of spool 85.

FIG. 21 is a further illustration of apparatus 10 installed for operation in room 31, but in a configuration and arrangement which differs from that of FIGS. 1-4. FIG. 21 is provided to demonstrate that the components comprising apparatus 10 can be adapted to provide the user with great latitude in positioning the apparatus consistent with the user's available building structure and space.

According to FIG. 21, winch 13 is mounted securely on wall 39 of room 31. Unlike the arrangement in FIGS. 1-4, wood ceiling joist 155 is parallel to wall 39 on which winch 13 is mounted. For example, joist 155 may be spaced outwardly a short distance from wall 39. Hooks 51, 53, 55 are mounted to wood ceiling joist 155 and pulleys 19, 21, 23, 25 are secured to respective hooks 51-55 providing anchor points for elongate elements 15, 17. All other aspects of apparatus 10 are as previously described and such description is incorporated by reference. Any of winch embodiments 13, 13' and 13" may be utilized as desired. The configuration and arrangement of apparatus 10 shown in FIG. 21 would be ideal for supporting a ladder or other article at an elevated position close to wall 39, thereby optimizing space in room 31.

OPERATION

In operation, elongate elements 15, 17 are wound partially about spool center 93 between inner and outer spool plates 89, 91. Each elongate element first end 57 is secured to spool 85 at cup 101 as previously described. Elongate elements 15, 17 are threaded onto respective pulleys 19-25 anchored to the room 31 structure by means of hooks 51-55 providing anchoring points for elongate elements 15, 17. A sufficient length of each elongate element 15, 17 is free of winch 13 to permit attachment of hangers 27, 29 to the article 11 to be elevated and stored. As noted elsewhere, each hanger 27, 29 is attached to a respective elongate element second end 59.

Hangers 27, 29 are next attached to article 11 at any convenient connecting position along such article 11. If a single hanger and elongate element is used, the hanger would be connected to article 11 at a single contact point. In embodiments including a spring clutch winch 13 with a folding lever 75, second segment 119 is unfolded and lever is ready to be rotated. At this point, article 11 and apparatus 10 are in the lowered position of FIG. 1 and apparatus 10 is ready to be used to elevate article 11.

Spool 85 is next rotated in a direction to wind elongate elements 15, 17 onto spool 85. Spool 85 may be rotated manually with lever 75 or automatically with motor 79 or 81 in respective winch embodiments 13' and 13".

As driving plate 109 is turned, spool driver 107 engages spring 95 spring arm 103 or 105. Force applied to a respective arm 103, 105 by a contact surface 111 or 113 expands spring 95 radially outward diminishing the frictional clamping force applied by spring 95 to axle 83 and enabling spring 95 to rotate about axle 83. Rotation of spring 95 causes one spring arm 103 or 105 to urge nub 97 and spool 85 to rotate about axle 83. Rotation of spool 85 causes elongate elements 15, 17 to be wound onto spool center 93. Force applied through elongate elements 15, 17 raises article 11 off of floor 41 to the elevated position of FIG. 2.

When force applied by spool driver 107 is abated spring 95 clamps radially inward against axle 83 applying sufficient frictional force so that spring 95 is held in 30 place on axle 83 and cannot rotate about axle 83 under normal loading conditions. In such state, one of arms 103 or 105 acts against nub 97 to brake, or limit, spool 83 rotation about axle 83 in either of directions 141, 143. Stoppage of spool 83 rotation holds article 11 in the elevated position shown in FIG. 2 for extended storage. Handle segment 119 may be folded onto winch to make winch more compact and enable operation of stop 131. Knob 123 and stop 131 act as a safety device preventing any unwanted rotation of knob 123 past stop 131. A detachable motor 81 maybe stored away for use on other projects.

While the principles of this invention have been described in connection with specific embodiments, it should be understood clearly that these descriptions are made only by way of example and are not intended to limit the scope of the invention.

The invention claimed is:

1. Apparatus for elevated storage of at least one article comprising:

a spring clutch winch comprising:

an axle;

a spool coaxially mounted for bi-directional rotational movement around the axle; and a helically-wound spring coaxially mounted around the axle such that, when at rest, the spring clamps radially against the axle limiting spool rotation and, when driven, the spring expands radially outward to rotate around the axle enabling bi-directional spool rotation;

at least one elongate element adapted to be wound onto the spool, each element having a first end for attachment to the spool and a second end;

at least one rotational support for supporting each elongate element; and a hanger for attachment to each elongate element second end and adapted to connect the at least one article to the elongate element.

2. The apparatus of claim 1 wherein the spring clutch winch further comprises:

a plate adapted to be secured to a surface with the axle extending outwardly from the plate;

a rotatable spool driver coaxially mounted about the axle such that rotation of the spool driver applies a loosening force to the spring causing the spring to expand radially outward and to rotate about the axle; and a drive mechanism powering bi-directional rotation of the spool driver.

3. The apparatus of claim 2 wherein the drive mechanism comprises a lever.

4. The apparatus of claim 3 wherein the lever comprises:

a first segment secured to the spool driver;

a second segment connected to a knob; and a hinge connecting the first and second segments such that the second segment folds over the first segment.

5. The apparatus of claim 4 further comprising a stop positioned to contact the knob when the lever is in the folded position to prevent lever movement.

6. The apparatus of claim 2 wherein the drive mechanism comprises a wheel.

7. The apparatus of claim 2 wherein the drive mechanism comprises:

at least one gear in power-transmission relationship with the spool driver; and a motor adapted to power the at least one gear to rotate the spool driver.

8. The apparatus of claim 7 wherein the at least one gear includes an input gear and the motor is adapted to be removably mated with the input gear.

9. The apparatus of claim 2 wherein the at least one elongate element comprises a pair of elongate elements each having a first end for attachment to the spool and a second end for attachment to the hanger.

10. The apparatus of claim 9 wherein each at least one elongate element is one of the group comprising a rope, a line and a cable.

11. The apparatus of claim 2 wherein the rotational supports are pulleys.

12. The apparatus of claim 2 wherein each hanger comprises:

a first end defining an opening for receiving an elongate element second end; and a second end defining a hook for connection to the article.

* * * * *